US006681523B1

(12) United States Patent
Stener

(10) Patent No.: US 6,681,523 B1
(45) Date of Patent: Jan. 27, 2004

(54) SECURITY GATE

(75) Inventor: Les Stener, Blaine, MN (US)

(73) Assignee: North States Industries, Inc., Minneapolis, MN (US)

( * ) Notice: Subject to any disclaimer, the term of this patent is extended or adjusted under 35 U.S.C. 154(b) by 151 days.

(21) Appl. No.: 09/694,123

(22) Filed: Oct. 20, 2000

Related U.S. Application Data

(60) Provisional application No. 60/161,209, filed on Oct. 22, 1999.

(51) Int. Cl.[7] ..... E06B 3/68

(52) U.S. Cl. ..... 49/55; 49/506; 160/216

(58) Field of Search ..... 49/463, 465, 57, 49/55, 506; 160/216, 222

(56) References Cited

U.S. PATENT DOCUMENTS 4,583,715 A 4/1986 Wright
4,968,071 A * 11/1990 Stern ..... 292/150
5,052,461 A 10/1991 Stern
5,272,840 A * 12/1993 Knoedler et al. ..... 49/463
5,528,859 A 6/1996 Taylor et al.
5,535,552 A 7/1996 Stern
5,657,809 A 8/1997 Longoria et al.
5,782,039 A * 7/1998 Scherer et al. ..... 49/465
5,829,505 A * 11/1998 Brescia ..... 49/465
5,906,068 A * 5/1999 Bode ..... 49/465

OTHER PUBLICATIONS

"The Great Gate With Pump Action", *North States Industries, Inc.*, 1 pg. (Oct. 1999).

* cited by examiner

*Primary Examiner*—Jerry Redman
(74) *Attorney, Agent, or Firm*—Merchant & Gould P.C.

(57) ABSTRACT

A security gate having an adjustable width that is suitable for use as a barrier to restrict the movement of children or animals. The gate includes a stationary panel and an overlapping moveable panel which are slidably extendable with respect to each other and lockable in a variety of extended positions. The gate can be pressure mounted to an opening, such as a hallway or doorway.

18 Claims, 16 Drawing Sheets

SECURITY GATE

This application claims priority to U.S. Provisional Application Serial No. 60/161,209, filed Oct. 22, 1999, entitled Security Gate, the disclosure of which is hereby incorporated by reference herein in its entirety.

FIELD OF THE INVENTION

This invention relates to a security gate for children or animals useful as a removable barrier for a passageway such as a hallway or doorway.

BACKGROUND OF THE INVENTION

Lightweight, removable safety barriers are often temporarily installed at the top or bottoms off stairways, in hallways, or in doorways to restrict the movement of small children and/or animals. However, most security gates require more than one hand to install or remove the gate. The need for two hands to install or remove a security gate can be problematic when the user's hands are occupied, for example, when holding a small child or groceries. Therefore, a removable safety gate that is easily installed or removed with one hand is desirable.

SUMMARY

The disclosure provides a security gate having an adjustable width that is suitable for use as a barrier to restrict the movement of children or animals. The gate includes a stationary panel and an overlapping moveable panel which are slidably extendable with respect to each other and lockable in a variety of extended positions. The gate can be pressure mounted to an opening, such as a hallway or doorway.

The gate includes a handle located at the top of the gate which operates a drive train configured to slidably move the movable panel relative to the stationary panel. The drive train includes a helical gear and at least one rotating element that contacts the surface of the stationary panel and the movable panel. When the handle is depressed towards the stationary gate, the helical gear rotates. Rotation of the helical gear causes the rotating element to turn. As the rotating element turns, the movable panel is laterally displaced relative to the stationary panel thus extending the gate.

DETAILED DESCRIPTION

The disclosure provides a security gate having an adjustable width that is suitable for use as a barrier to restrict the movement of children or animals that can be pressure mounted to an opening, such as a hallway or doorway.

The Gate

The gate will now be described with respect to the figures. Like numbers will be used to identify like elements in the various figures.

Figure 1:
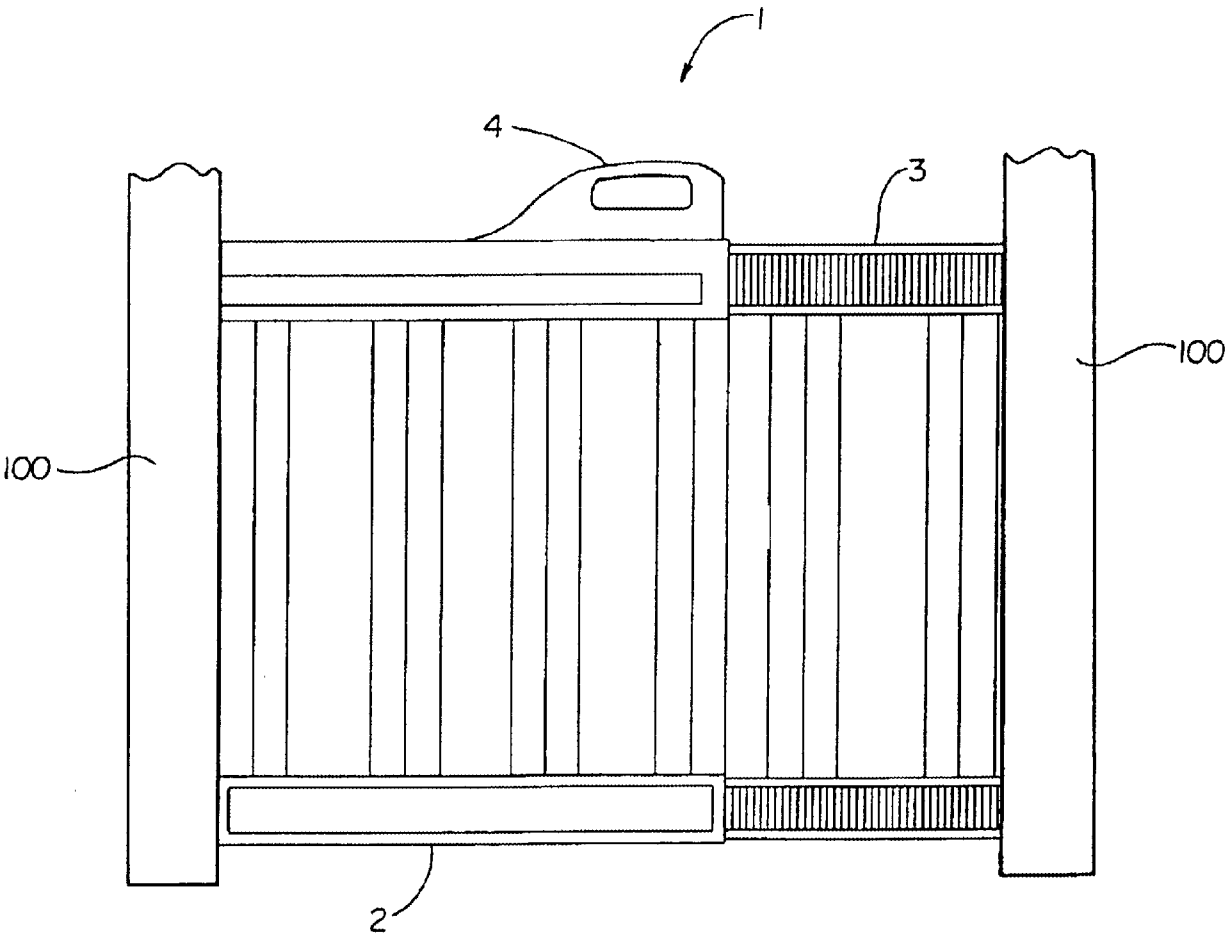
FIG. 1 is an elevational view showing the gate in position in a door frame.

This disclosure provides a removable gate 1. An elevational view of the gate 1 mounted to a door frame 100 is shown in FIG. 1. The gate 1 includes a stationary panel 2 slidably engaged to a movable panel 3. The stationary panel 2 and the moveable 3 panel each have an exterior surface 8A, 8B and an interior surface 9A, 9B. Preferably, the interior surface 9A, 9B of at least the moveable panel 3, more preferably both the moving panel and the stationary panel, include at least one surface which coordinates with the rotating element(s) 13, 14. In one example, the interior surfaces 9A, 9B of the stationary 2 and moveable 3 panels include at least one gear rack 40A, 40B, 40C, 40D which coordinate with ridges 70 on the surface of the rotating element(s) 13, 14. Preferably, the interior surface 9B of the moveable panel 3 includes at least one gear rack 40B or 40D. More preferably, the interior surface 9B of the moveable panel 3 includes at least one gear rack 40B or 40D and the interior surface 9A of the stationary panel 2 includes at least one gear rack 40A or 40C. Most preferably, the interior surface 9B of the moveable panel 3 includes two gear racks 40B and 40D and the interior surface 9A of the stationary panel 3 includes two gear racks 40A and 40C. The gate 1 also includes a handle 4 located at the top of the gate 1, preferably connected to the stationary panel 2.

Figure 2:
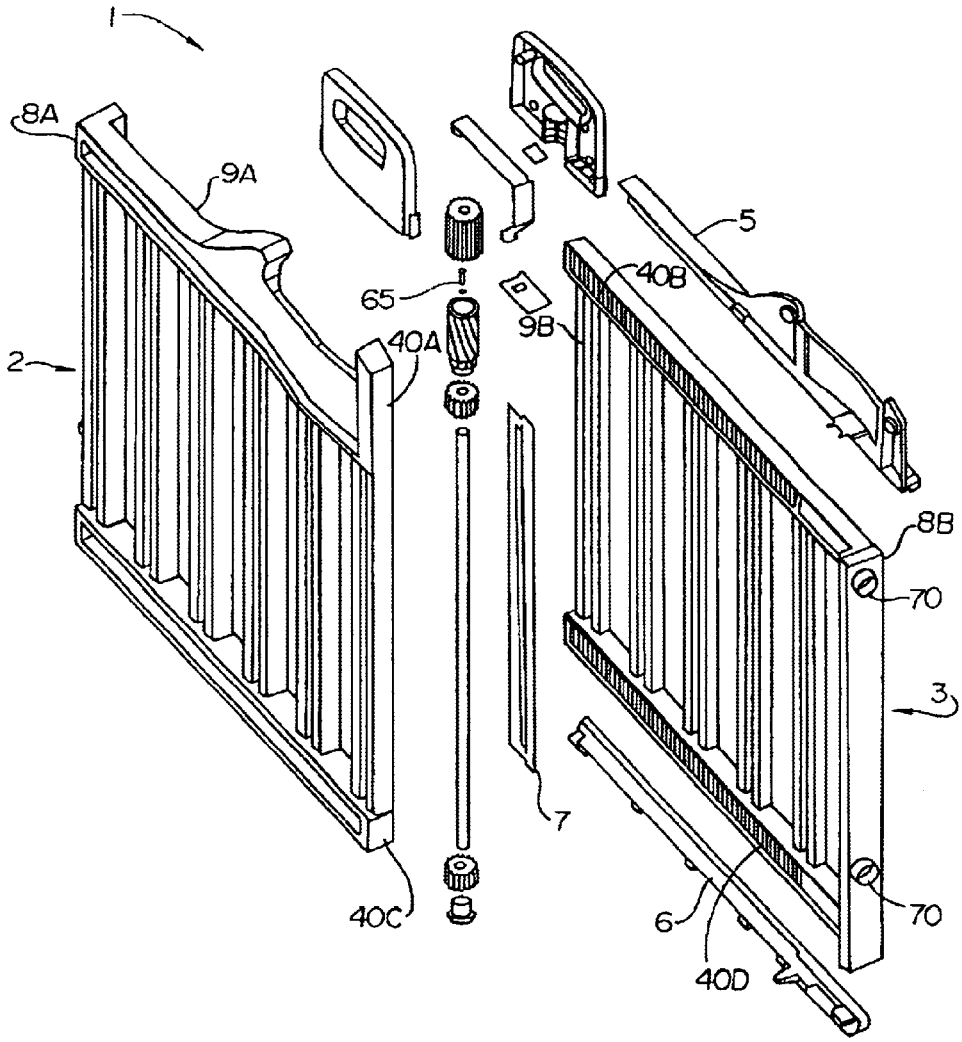
FIG. 2 is an exploded view of the gate.

An exploded view of the gate 1 is shown in FIG. 2. The handle 4 is operably connected to a drive train 10 which includes a helical gear 11 that is operably connected to at least one rotating element 13, 14. The rotating element(s) 13, 14 contact the interior surfaces 9A, 9B of the stationary 2 and moveable 3 panels.

Figure 3:
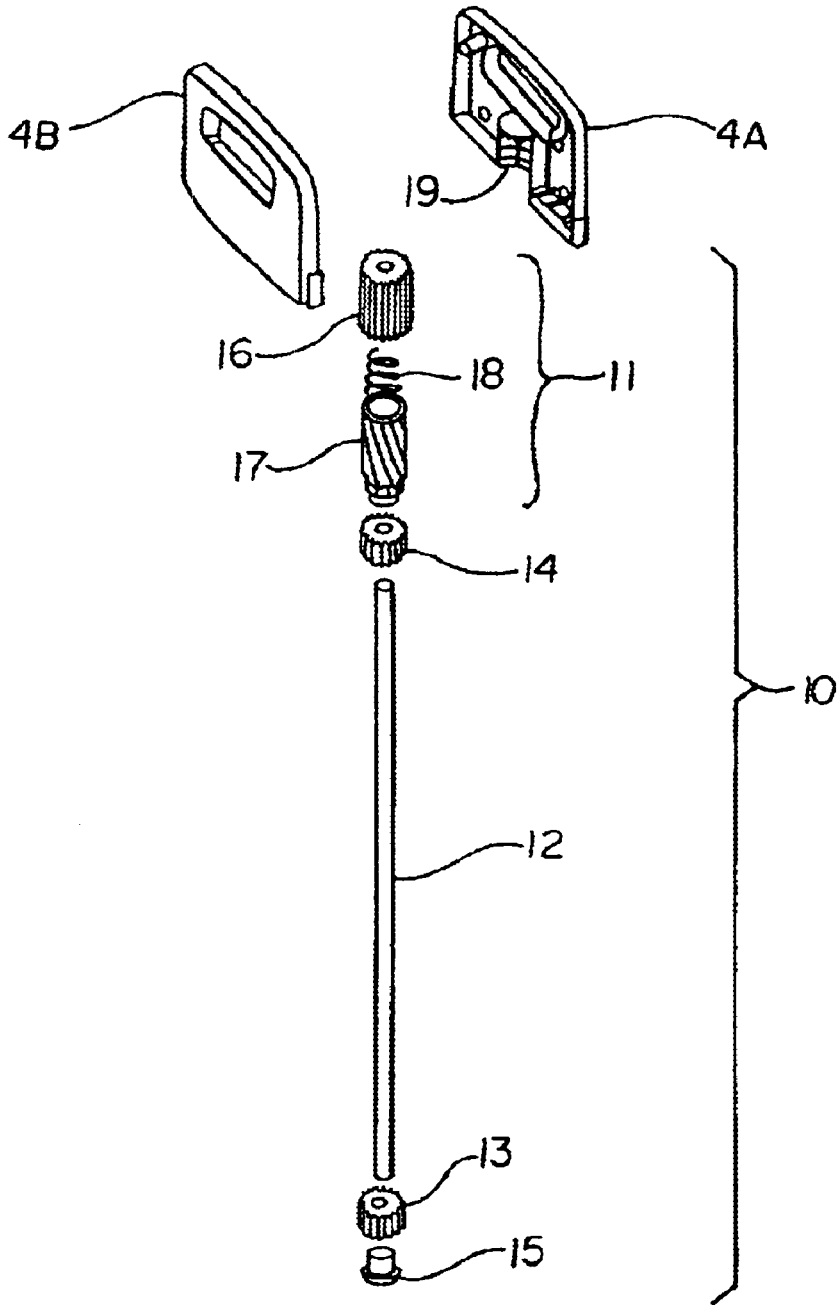
FIG. 3 is an exploded view of the handle and drive train.
Figure 4:
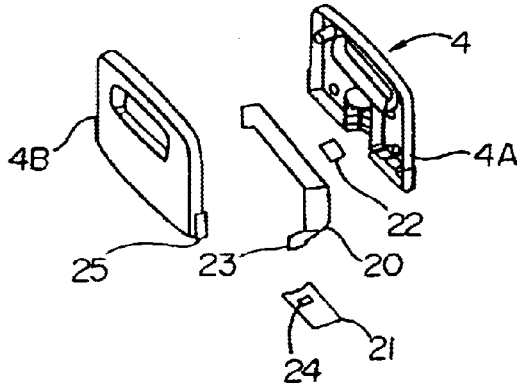
FIG. 4 is an exploded view of the handle and latching mechanism.
Figure 5:
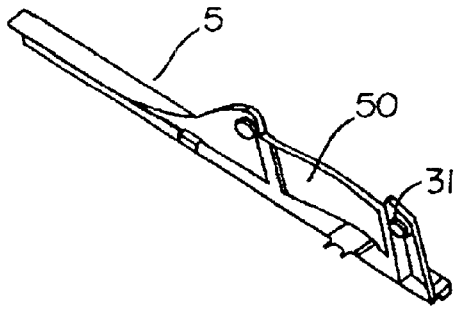
FIG. 5 shows the top retaining panel.

An exploded view of the handle 4 and drive train 10 is shown in FIG. 3. The drive train 10 includes a helical gear 11 and at least one rotating element 13, 14 that contacts the surface of the stationary panel 2 and the movable panel 3.

Figure 6:
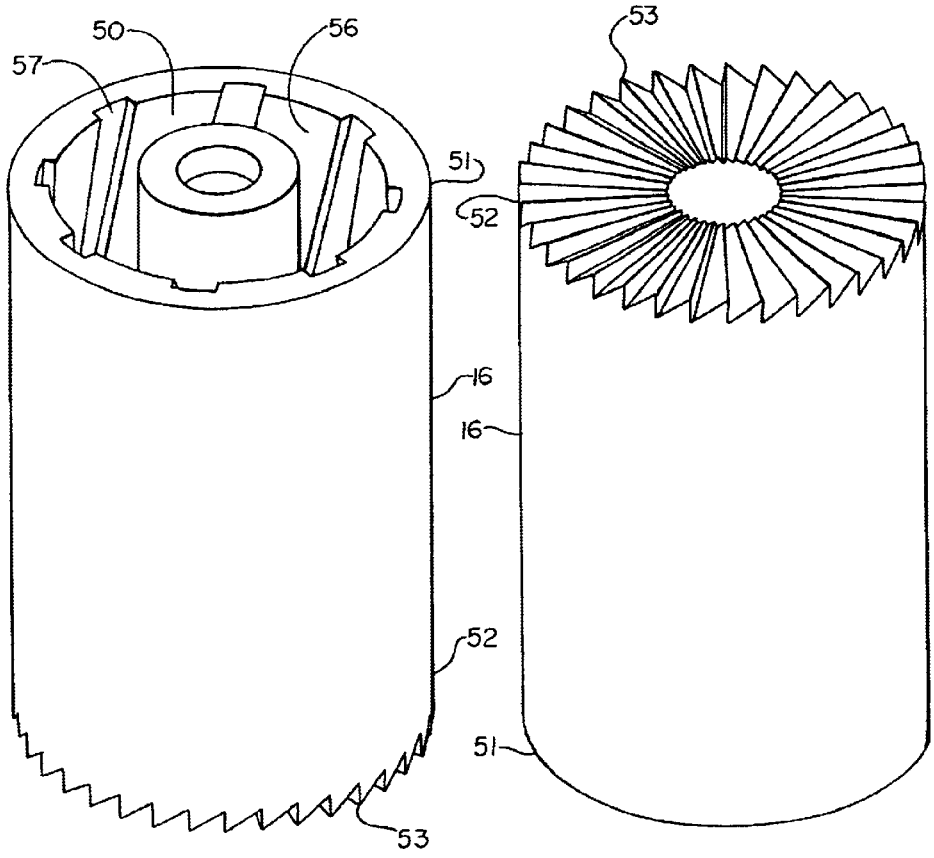
FIG. 6 shows the upper half of the helical gear.

Generally, the helical gear 11 comprises two halves, an upper half 16 and a lower half 17. The upper half 16 of the helical gear 11 is shown in FIG. 6. The upper half 16 of the helical gear 11 is generally hollow and cylindrical and defines a opening 50 at the base 51. The top surface 52 of the upper half 16 of the helical gear 11 has splines 53 that are angled on one face and flat on the other face, such that a cross section of the spline approximates a right triangle. These splines 53 are configured to mate with similar splines 54 on the interior 55 of the handle 4 (See FIG. 8). The interior surface 56 of the upper half 16 of the helical gear 11 defines ridges 57 that coordinate with threads 58 on the lower half 17 of the helical gear 11 (See FIG. 7).

Figure 7:
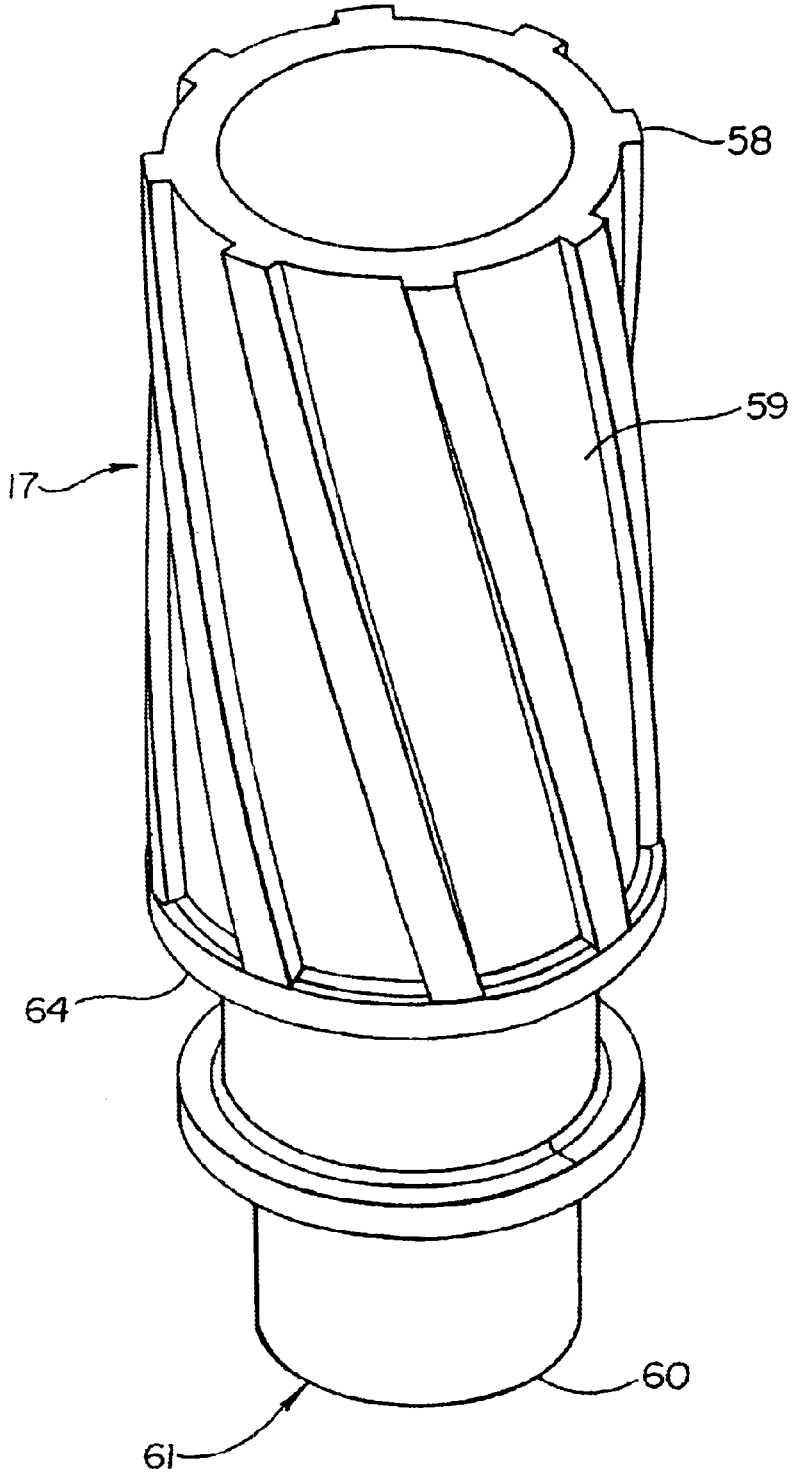
FIG. 7 shows the lower half of the helical gear.
Figure 8:
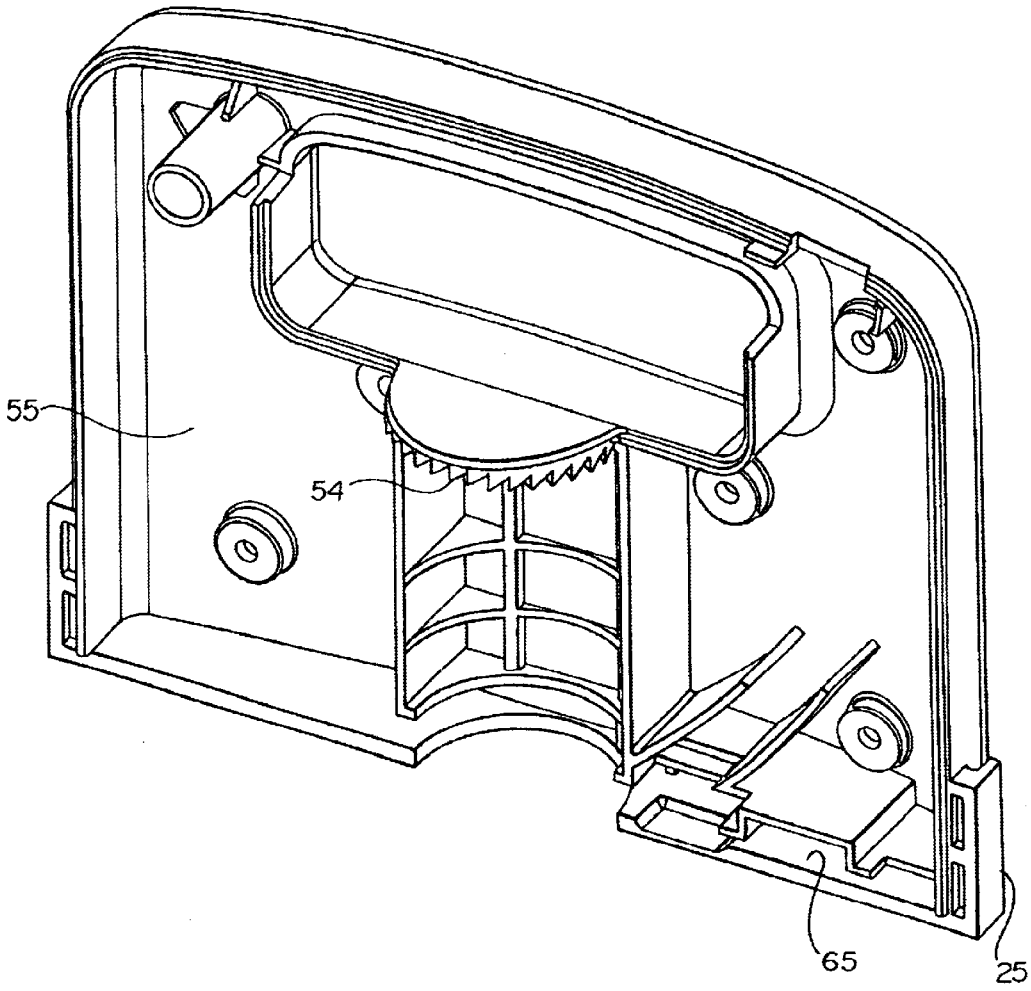
FIG. 8 shows a cross section of the handle.

The lower half 17 of the helical gear 11 is shown in FIG. 7. The lower half 17 of the helical gear 11 is generally cylindrical and has an outer circumference that is slightly smaller than the inner circumference of the upper half 16 of the helical gear 11. The lower half 17 of the helical gear 11 thus fits within the hollow opening 50 of the upper half 16 of the helical gear 11 in a rotatably telescoping manner. The external surface 59 of the lower half 17 of the helical gear 11 includes threads 58. Preferably, the threads 58 revolve approximately 0.25 to 0.2 of a rotation around the lower half of 17 the helical gear 11 in a span of approximately 2 to 2.5 inches along the length of the lower half 17 of the helical gear 11. The threads 58 of the lower half 17 of the helical gear 11 coordinate with the ridges 57 defined by the interior surface 56 of the upper half 16 of the helical gear 11.

Preferably, a biasing member 18 is included within the helical gear 11 to bias the upper 16 and lower 17 halves of the helical gear 11 away from one another. Preferably, the biasing member 18 is a spring. In FIG. 3, the biasing member 18 is shown as a coiled spring.

Figure 11:
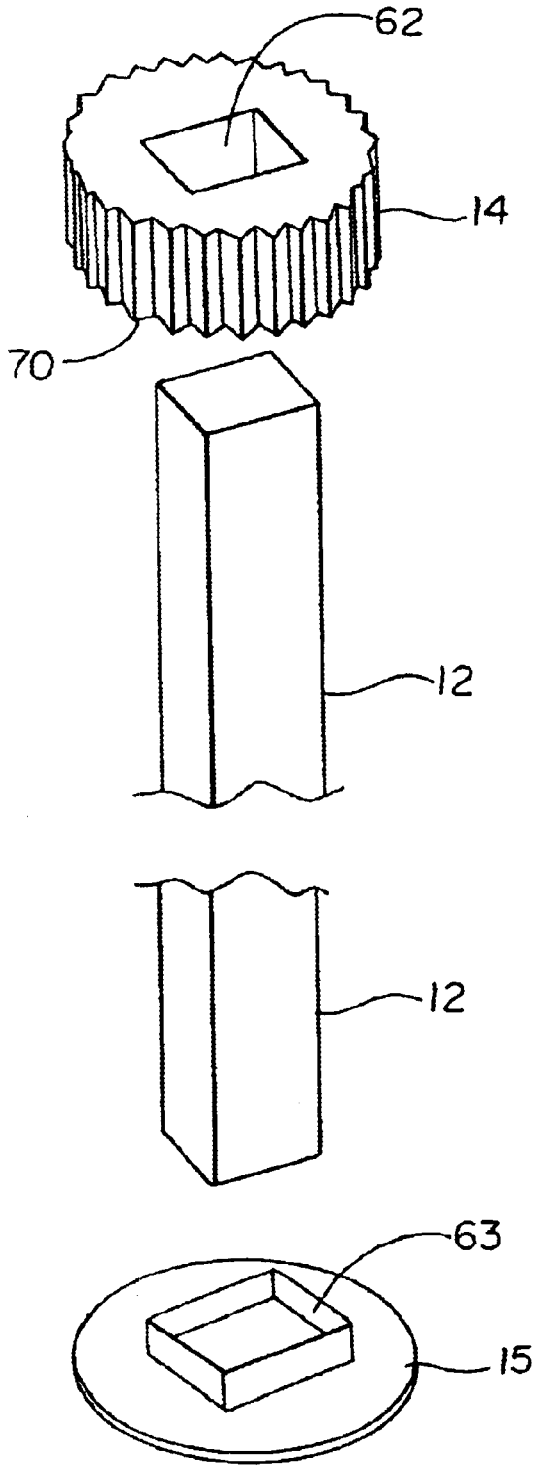
FIG. 11 shows an exploded view of the drive train.
Figure 12:
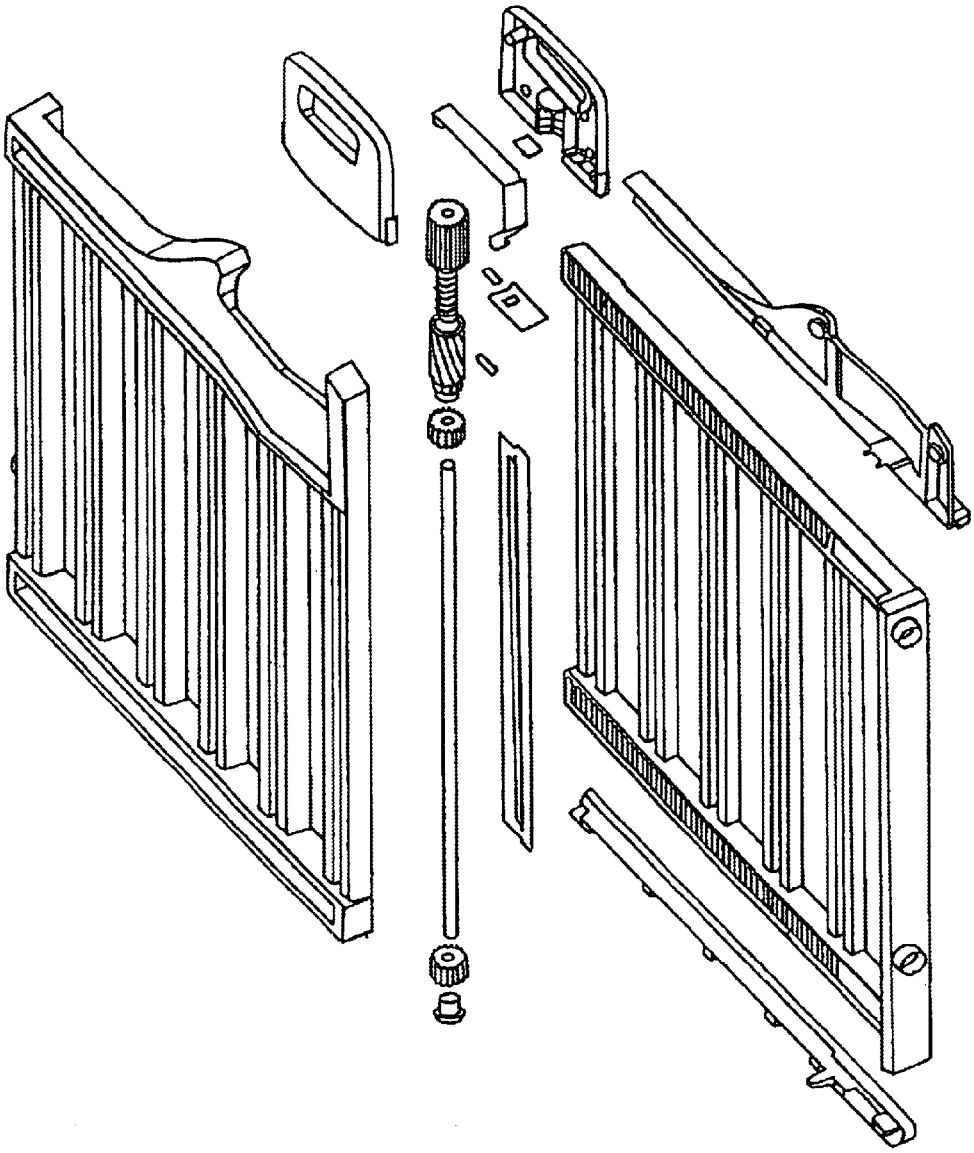
FIG. 12 is an exploded view of the gate.
Figure 13A:
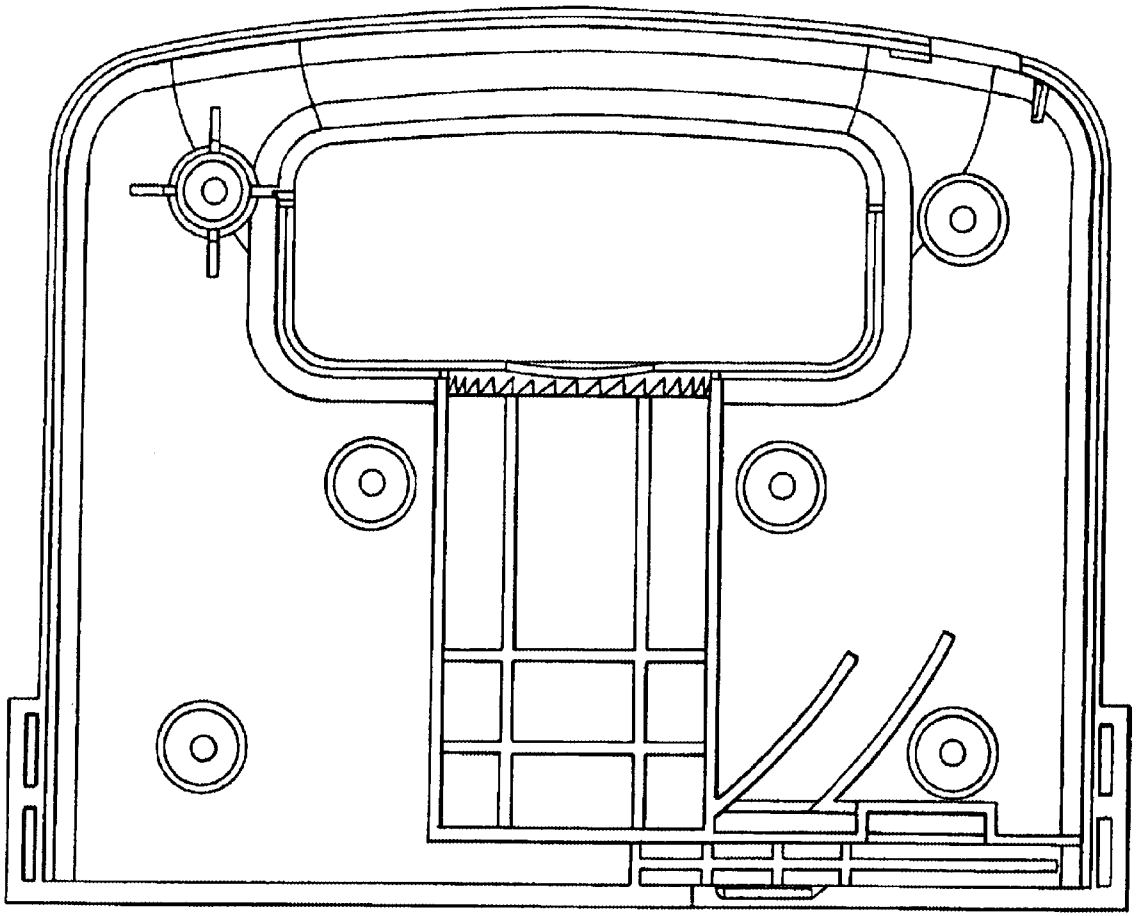
FIG. 13 shows a cross section of the handle.
Figure 13B:
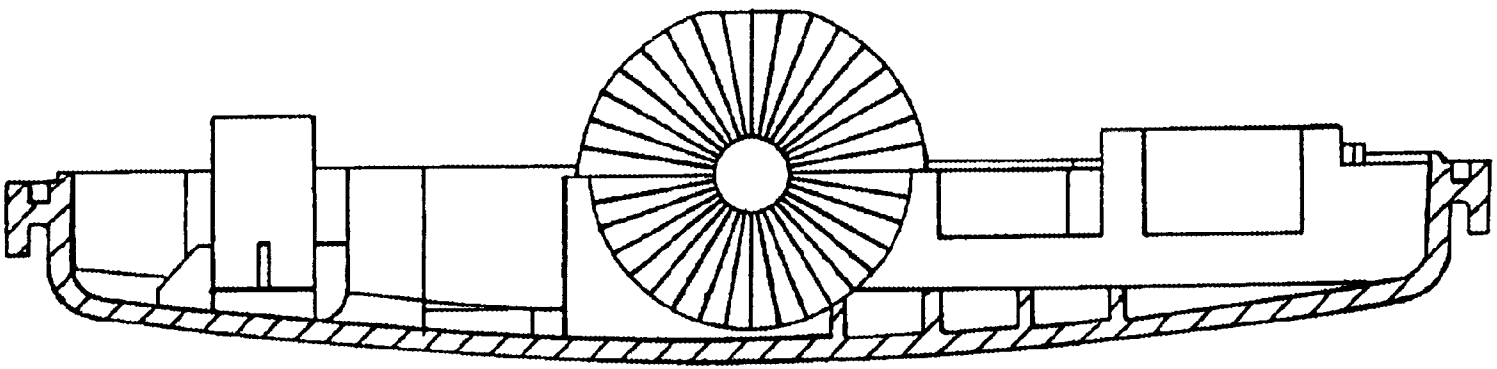
Figure 14:
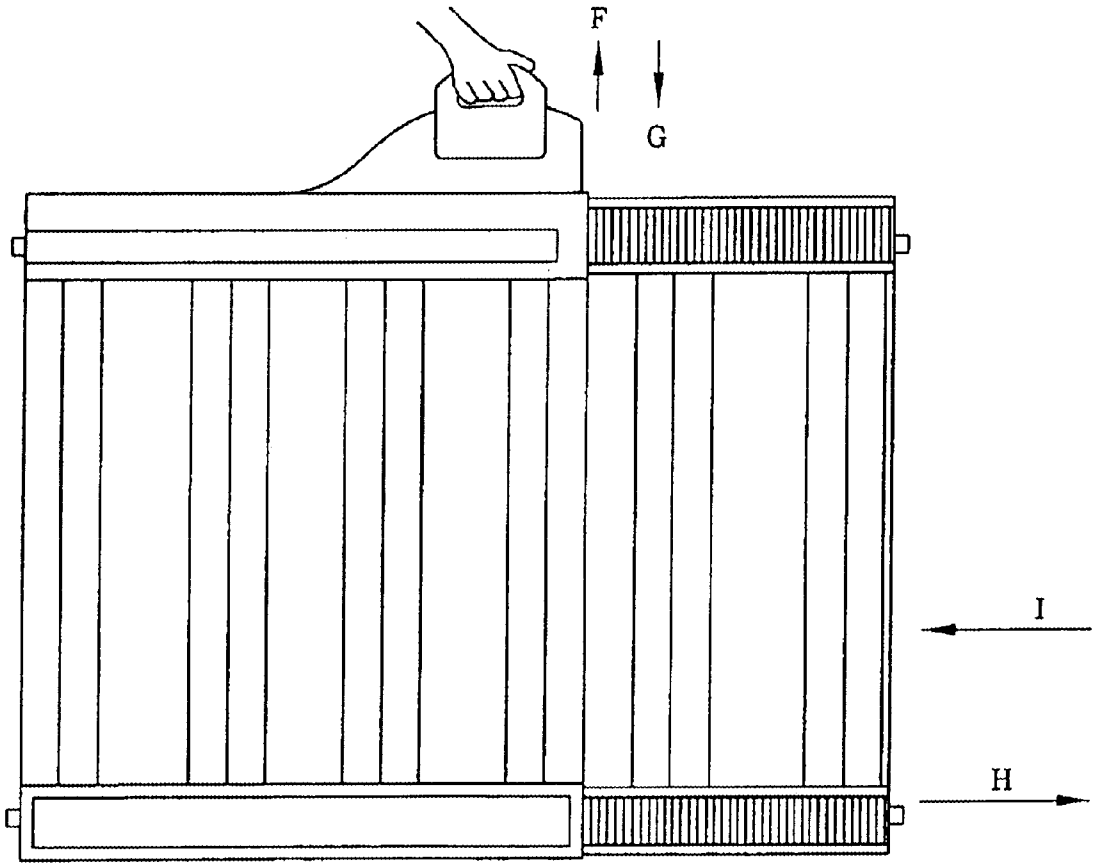
FIG. 14 is an elevational view of the gate during operation.

At least one rotating element 13, 14 is operably coupled with the helical gear 11 wherein turning the helical gear 11 turns the rotating element 13, 14. A variety of suitable coupling arrangements are known. For example, in the drive train 10 shown in FIG. 3, the drive train 10 includes two rotating elements 13, 14 and a drive shaft 12. The drive shaft 12 has a contoured cross section, for example, the drive shaft 12 may have a hexagonal or square cross section (See FIG. 11). The base 60 of the lower half 17 of the helical gear 11 defines an opening 61 that is contoured to mate with the contoured cross section of the drive shaft 12. The rotating elements 13, 14 also define an opening 62 that is contoured to mate with the contoured cross section of the drive shaft 12. Consequently, when the helical gear 11 is turned, the drive shaft 12 and rotating elements 13, 14 are also turned. Alternately, the helical gear 11 can be secured to the rotating elements 13, 14 and/or drive shaft 12 or the rotating elements 13, 14 can be secured to the drive shaft 12 using a securing member 65 such as screw, bolt, staple, rivet, glue or by welding.

In one embodiment, the drive train 10 and various elements thereof are aligned and positioned by contours on the interior surface 9A of the stationary panel 2. The gate 1 may also include a cover panel 7 to conceal the drive train 10.

Preferably, the drive train 10 also includes and end cap 15 configured to secure the drive train 10 to the stationary panel 2. More preferably, the end cap 15 defines an opening 63 which is contoured to mate with the contoured cross section of the drive shaft 12. See, for example, FIG. 11.

The gate 1 also includes at least one retaining rail 5, 6 secured to the stationary panel 2 using a securing element such as a screw, bolt, staple, glue, rivet or by welding. The retaining rail 5,6 and stationary panel 2 define a track which the moveable panel 3 slidably engages. The top retaining rail 5 preferably defines a recess 30 which encircles the handle 4. Preferably the top retaining rail includes a latching member 31 which engages the retainer 25 on the handle 4 when the handle 4 is pulled away from the stationary panel 2 to prevent the handle 4 from being removed from the recess 30.

The gate 1 also includes a locking mechanism which is releaseably engaged to lock and unlock the gate in an extended position. The locking mechanism will now be described with reference to FIGS. 4, 7, 9 and 10. The locking mechanism comprises a trigger 20 and a latch 21. The trigger 20 is preferably approximately "L" shaped with a primary element 76 positioned horizontally within the handle 4 and a secondary element 77 positioned vertically within the handle 4. The trigger 20 preferably defines an opening 71 at the tip of the horizontal primary element 76; a hooking element 23 at the base of the vertical secondary element 77; and a notch 73 on the upper surface of the primary element 76 proximate the "elbow" 9 of the "L" shaped trigger 20. The opening 71 is sized to fit a post 72 that is attached to the inner surface of the handle 4. The latch 21 preferably defines a receptacle 24 which is sized to receive the hooking element 23 of the vertical secondary element 77. The latch 21 is configured to slide along the inner base 65 of the handle and engage the shoulder 64 of the lower helical gear 17. Preferably, the face of the latch 21 that engages the shoulder 64 of the lower half 17 of the helical gear 11 is concave.

Figure 9:
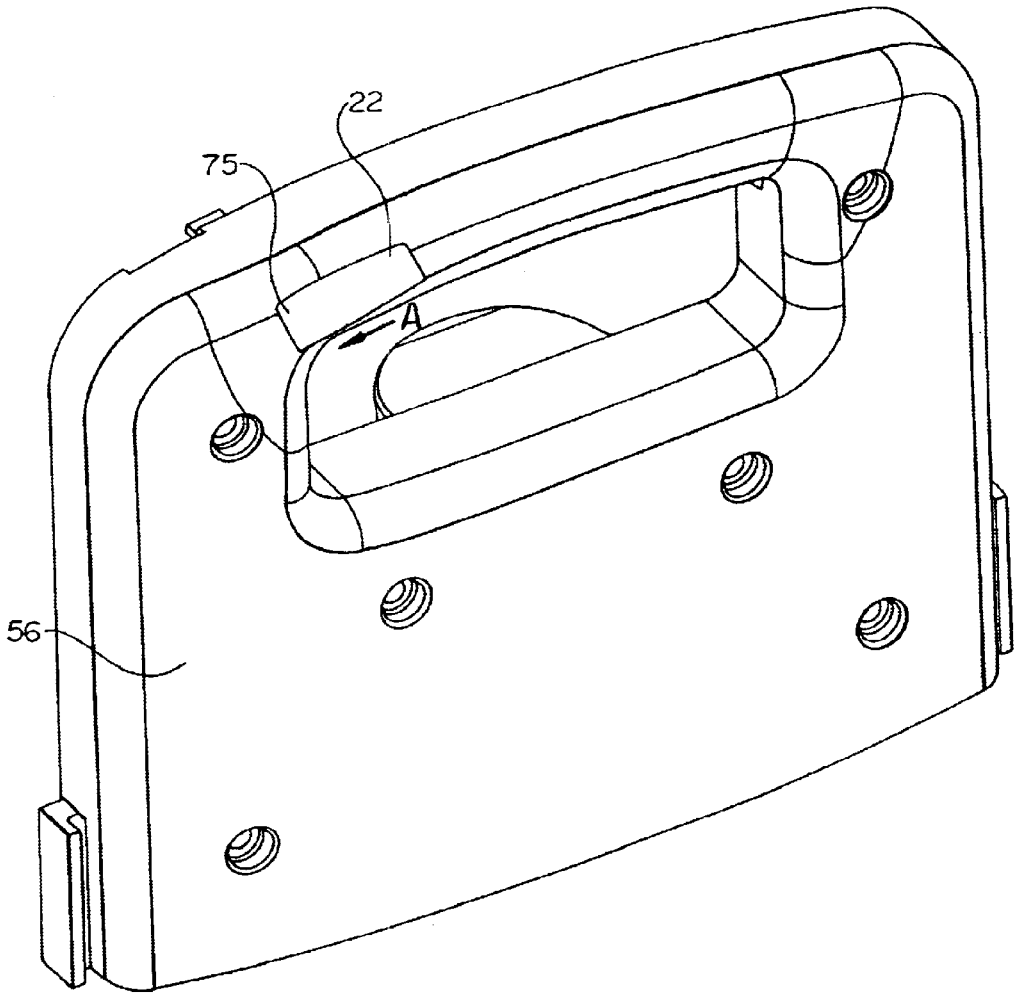
FIG. 9 shows an elevational view of the handle.
Figure 10A:
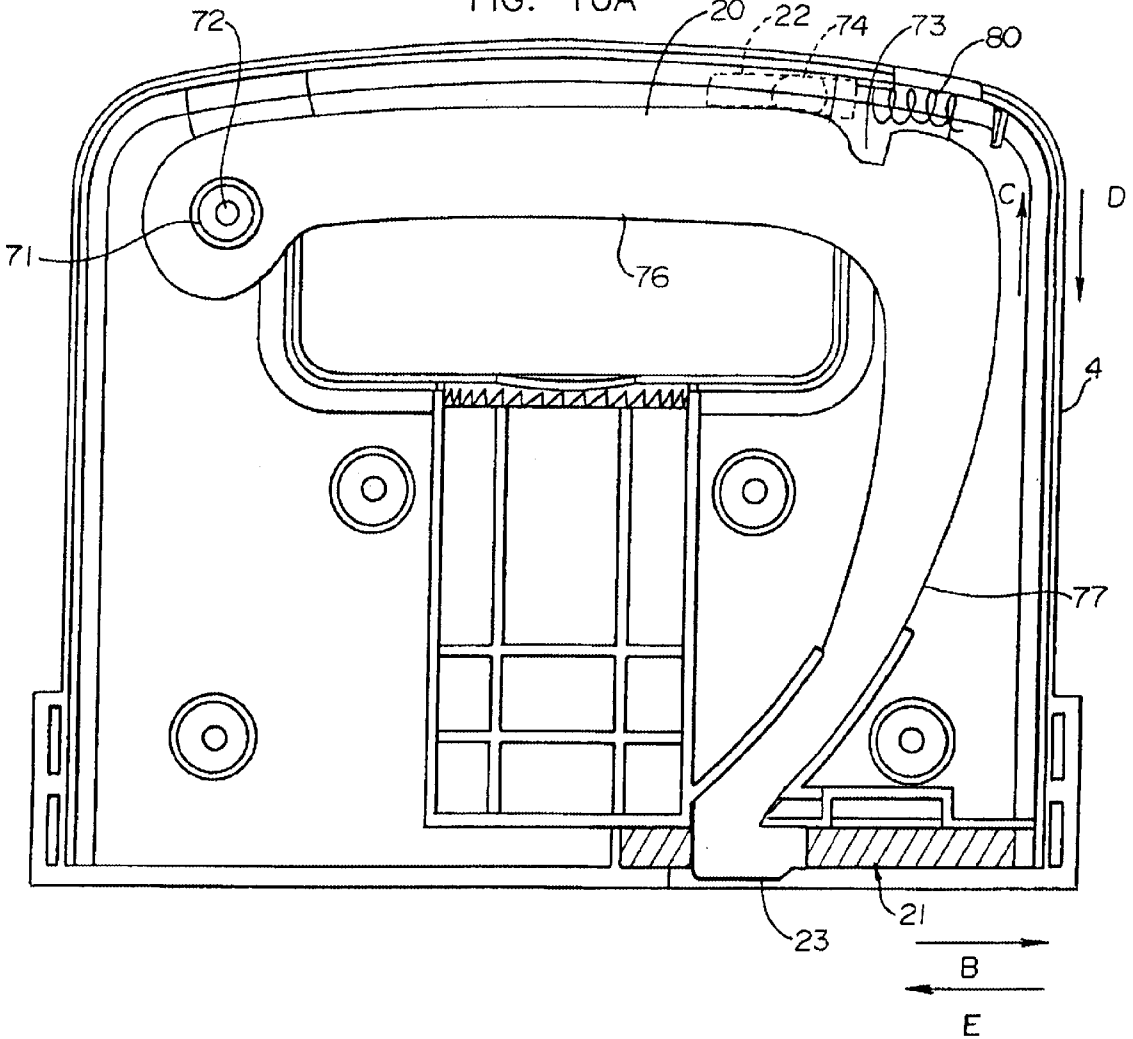
FIG. 10 shows a cross section of the handle with the trigger.
Figure 10B:
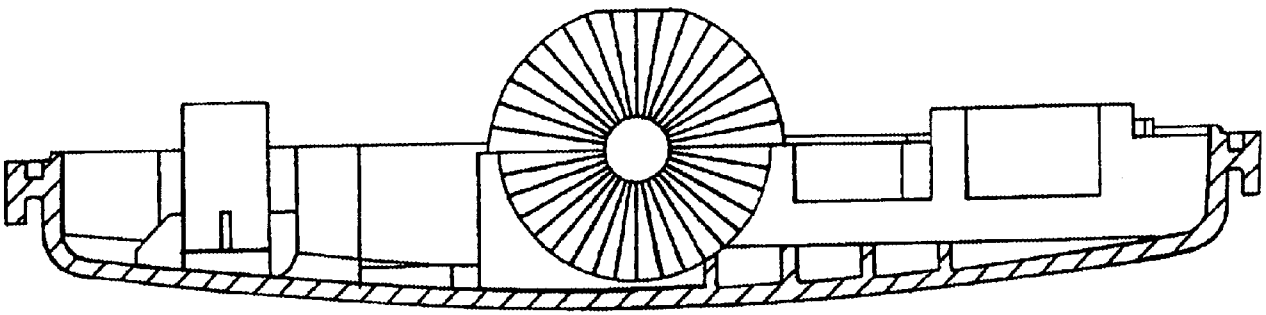

Preferably, the handle 4 also includes a safety lock 22 which comprises a knob 74 that is configured to fit within the notch 73 defined by the trigger 20. Preferably, the safety lock 22 is biased such that it does not align with the notch 73 defined by the trigger 20. In one example, the biasing element 80 comprises a spring. In FIG. 10, the biasing element 80 is shown as a coiled spring. Preferably the handle 4 defines an opening 75 which exposes a surface of the safety lock 22 as shown in FIG. 9.

The gate 1 may also include flexible bumpers 70 which engage the frame 100 of the opening. In one example, a "U" shaped element (not shown) is fastened to the frame 100 of the opening and the flexible bumpers 70 of the gate are positioned within the "U" shaped element to provide additional stability to the gate. Preferably, the gate 1 is fastened using "U" shaped elements when the gate 1 is used as a barrier at the top of a staircase.

Extending the Gate

The gate 1 is extended (in the direction of arrow "H") by "pumping" the handle 4 up and down (away from and towards the stationary panel 2 in the direction of arrows "F" and "G" respectively). The handle 4 is operably connected to a drive train 10 that is configured to slidably move the movable panel 3 relative to the stationary panel 2. The drive train 10 includes a helical gear 11 and at least one rotating element 13, 14 that contact the inner surface 9A, 9B of at least the movable panel 3, and preferably both the moveable panel 3 and the stationary panel 2. When the handle 4 is depressed towards the stationary panel 2 (in the direction of arrow "G"), the splines 54 on the handle 4 engage the splines 53 on the top surface 52 of the upper half 16 of the helical gear 11. The mating of the splines 53, 54 prevents the upper half 16 of the helical gear 11 from rotating as the handle 4 is depressed.

The ridges 57 defined by the interior surface 56 of the upper half 16 of the helical gear 11 communicate with the threads 58 on the surface 59 of the lower half 17 of the helical gear 11. As the upper half 16 of the helical gear 11 is depressed, the lower half 17 of the helical gear 11 rotatably telescopes inside the hollow opening of the upper half 16 of the helical gear 11. The communication of the threads 58 on the surface 59 of the lower half 17 of the helical gear 11 and the ridges 57 defined by the interior surface 56 of the upper half 16 of the helical gear 11 cause the lower half 17 of the helical gear 11 to rotate. Rotation of the lower half 17 of the helical gear 17 causes the drive shaft 12 and/or the rotating element(s) 13,14 to turn. As the rotating element(s) 13, 14 turn, surface of the rotating element frictionally engages the inner surface 9A, 9B of at least the moveable panel 2 and preferably the moveable panel 2 and the stationary panel 3 such that the movable panel 2 is laterally displaced relative to the stationary panel 3, thus extending the gate. Alternately, the surface of the rotating element(s) 13, 14 may have ridges 70 which communicate with ridges on at least one gear rack 40A, 40B, 40C, 40D on the interior surface 9A, 9B of the stationary 2 and/or moveable 3 panels.

When the handle 4 is pulled up (away) from the stationary panel 2 (in the direction of arrow "F"), the splines 54 on the handle 4 disengage from the splines 53 on the top surface 52 of the upper half 16 of the helical gear 11. The biasing member 18 biases the lower half 17 of the helical gear 11 apart from the upper half 16 of the helical gear 11. As the two halves of the helical gear move apart from one another, the top half 16 of the helical gear 11 (which is no longer engaged by the splines 54 of the handle) freely rotates. The bottom half 17 of the helical gear 17 is held in place due to the interaction between the rotating elements 13, 14 and the interior surface 9A, 9B of the stationary 2 and/or moveable 3 panels.

The Locking Mechanism

The locking mechanism will be described with reference to FIG. 10. As shown in FIG. 10, the trigger 20 is positioned within the handle 4 such that the horizontal primary element 76 of the trigger is visible along the upper edge of the window 78 defined by the handle 4. The opening 71 at the tip of the horizontal primary element 76 encircles a post 72 attached to the inner surface of the handle 4 such that when the trigger 20 is pulled, the tip of the horizontal primary element 76 remains stationary. However, the "elbow" of the trigger 20 moves towards the top of the handle 4 (in the direction of arrow "C"). This movement of the primary element 76 of the trigger 20 causes the base of the secondary element 77 (and the hooking element 23) to move in the direction of arrow "B". Because the hooking element 23 is mated with the receptacle 24 of the latch 21, the latch also moves in the direction of arrow "B". This movement of the latch 21 causes the latch 21 to disengage the lower half 17 of the helical gear 11. When the latch 21 is disengaged from the lower half 17 of the helical gear 11, the handle 4 can be "pumped" up and down to extend the gate. When the trigger 20 is released, the primary element 76 of the trigger 20 moves in the direction of arrow "D" causing the base of the secondary element 77 (and the hooking element 23) to move in the direction of arrow "A". If the handle 4 is pushed all the way down to the stationary panel 2, the latch 21 is then able to engage the shoulder 64 of the lower half 17 of the helical gear 11 and thus lock the gate 1 in any extended or collapsed position.

Preferably the gate 1 also includes a safety lock 22. In one example, the safety lock 22 comprises a knob 74 that is configured to fit within the notch 73 defined by the trigger. Preferably, the safety lock 22 is biased such that the knob 74 does not align with the notch 73 defined by the trigger 20. Thus, when the safety lock 22 is in a locked position, the knob 74 rests above the horizontal primary element 76 of the trigger 22 and prevents upward movement of the trigger 20. To unlock the safety lock 22, the knob 74 is displaced such that the knob 74 aligns with the notch 73 of the trigger 20. The trigger 20 can then be pushed upwards. In the example shown in FIG. 9, the safety lock 22 can be displaced in the direction of arrow "A" by frictionally contacting the surface of the safety lock 22 through the opening 75 defined by the handle 4.

Releasing the Gate

To release the gate, the safety lock 22 is displaced such that the knob 74 of the safety lock 22 aligns with the notch 73 in the trigger 20. The horizontal primary element 76 of the trigger 20 is pressed upwards (in the direction of arrow "C") to disengage the latch 21 from the lower half 17 of the helical gear 11. The handle 4 is then lifted up (away) from the stationary panel 2 (in the direction of arrow "F"). This releases the splines 53 of the upper half 16 of the helical gear 11 from the splines 54 of the handle. When the handle 4 is pulled up (away) from the stationary panel 2, the splines 54 on the handle 4 disengage from the splines 53 on the top surface 52 of the upper half 16 of the helical gear 11. The biasing member 18 biases the lower half 17 of the helical gear 11 apart from the upper half 16 of the helical gear 11. As the two halves of the helical gear move apart from one another, the top half 16 of the helical gear 11 (which is no longer engaged by the splines 54 of the handle) freely rotates. When the helical gear 11 is thus disengaged, the stationary 2 and moveable 3 panels easily slide relative to one another. The gate can then be released by sliding the movable panel 3 toward the stationary panel 2 (in the direction of arrow "I"). For convenience, it is preferred that the panels 2, 3 are pushed together (maximum overlap) for storage and transportation.

Although a particular embodiment has been described above, it will be readily appreciated that various modifications can be made without departing from the scope of the claims.

What is claimed is:

1. An extendable and retractable gate comprising:

a. a stationary panel;

b. a movable panel slidably engaged to the stationary panel;

c. a handle operably connected to either the stationary panel or moveable panel; and d. a drive train operably connected to the handle, said drive train comprising a helical gear operably connected to at least one rotating element that engages at least one surface of the stationary or moveable panel.

2. The gate according to claim 1, wherein at least one gear rack is located on an interior surface of the stationary panel.

3. The gate according to claim 1, wherein at least one gear rack is located on an interior surface of the moveable panel.

4. The gate according to claim 1, wherein an interior surface of the moveable panel comprises a top and a bottom, and at least one gear rack is located proximate the top of the interior surface and at least one gear rack is located proximate the bottom of the interior surface.

5. The gate according to claim 1, wherein the helical gear comprises:

a. a cylindrical upper half having a top surface and a bottom surface, wherein the top surface comprises splines, and the bottom surface defines an opening having a circumference and an interior surface wherein said interior surface comprises ridges;

b. a cylindrical lower half comprising an outer surface and a bottom surface comprising a contoured inlet, wherein the outer surface of said lower half is threaded and circumferentially smaller than the circumference of the opening defined by the bottom surface of the upper half; and c. a biasing member;

wherein the lower half is biased from and fits into the upper half in a rotatably telescoping manner.

6. The gate according to claim 5, wherein the splined top surface of the upper half of the helical gear mates with a splined surface in the handle.

7. The gate according to claim 5, wherein the biasing member is a spring.

8. The gate according to claim 7 wherein the drive train comprises:

a. at least one rotating element comprising a contoured opening;

b. a drive shaft comprising a contoured cross section;

wherein the drive shaft operably mates with the contoured inlet of the bottom surface of the lower half of the helical gear and the contoured openings of at least one rotating element.

9. The gate according to claim 7, including a locking mechanism comprising a trigger and a latch operably connected to the handle.

10. The gate according to claim 9, wherein the trigger is "L" shaped and comprises:

a. a primary element slidably positioned within the handle;

b. a secondary element slidably positioned substantially perpendicular to the said primary element within the handle;

wherein the primary element of the trigger defines an opening and the secondary element defines a hooking element, and the trigger defines a notch proximate the "elbow" of the "L" shaped trigger.

11. The gate according to claim 10, wherein the handle further comprises a knob configured to fit within the notch defined by the trigger.

12. The gate according to claim 10, wherein the knob is biased by a biasing member such that it does not align with the notch defined by the trigger at rest.

13. The gate according to claim 12, wherein the biasing member comprises a coiled spring.

14. The gate according to claim 10, wherein the latch defines a receptacle sized to receive the hooking element of the secondary element, and is configured to engage the lower helical gear when in a locked position.

15. The gate according to claim 1, wherein one or more bumpers are located on an end surface of the stationary or moveable panel.

16. An extendable and retractable gate comprising:

a. a stationary panel;

b. a movable panel slidably engaged to the stationary panel, wherein at least one of the movable panel or the stationary panel comprise at least one gear rack;

c. a handle operably connected to either the stationary panel or moveable panel wherein the handle comprises a knob and a splined surface;

d. a drive train operably connected to the handle, said drive train comprising:

i. a helical gear comprising:

a. a cylindrical upper half having a top surface and a bottom surface, wherein the top surface comprises splines, and the bottom surface defines an opening and an interior surface wherein said interior surface defines a circumference and comprises ridges;

b. a cylindrical lower half comprising an outer surface and a bottom surface comprising a contoured inlet, wherein the outer surface of said lower half is threaded and circumferentially smaller than the circumference of the interior surface of the upper half; and c. a biasing member;

wherein the lower half is biased from and fits into the upper half in a rotatably telescoping manner, and wherein the splined top surface of the upper half of the helical gear mates with the splined surface in the handle; and ii. at least one rotating element that engages at least one surface of the stationary or moveable panel, wherein at least one of said rotating element is operably connected to the helical gear.

17. The gate according to claim 16, further comprising e. a locking mechanism comprising:

i. an "L" shaped trigger comprising:

a. a primary element slidably positioned within the handle; and b. a secondary element slidably positioned perpendicular to the said primary element within the handle;

wherein the primary element of the trigger defines an opening and the secondary element defines a hooking element, and the trigger defines a notch proximate the "elbow" of the "L" configured to receive the knob located on the handle; and ii. a latch operably connected to the handle, wherein said latch defines a receptacle sized to receive the hooking element of the secondary element, and configured to engage the lower helical gear when in a locked position.

18. A method for extending a gate according to claim 17, comprising:

a. displacing the knob from the notch in the trigger to release the trigger and disengage the latch from the lower half of the helical gear;

b. pulling up on the handle to disengage the splines of the handle from the splines of the top surface of the upper half of the helical gear;

c. pushing the handle in a downward motion, thereby engaging the splines of the handle and the splines of the top surface of the upper half of the helical gear to prevent the upper half of the helical gear from rotating as the handle is pushed downward wherein the ridges of the upper half of the helical gear and the threads of the lower half of the helical gear are engaged such that the downward motion of the handle causes the lower half of the helical gear to rotate, thereby extending the gate; and d. engaging the knob with the notch in the trigger to engage the latch with the lower helical gear, thus locking the drive train.

* * * * *